US009083116B2

(12) United States Patent
Oshita

(10) Patent No.: US 9,083,116 B2
(45) Date of Patent: Jul. 14, 2015

(54) CONNECTOR

(75) Inventor: Osamu Oshita, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 2 days.

(21) Appl. No.: 13/985,495

(22) PCT Filed: Mar. 1, 2012

(86) PCT No.: PCT/JP2012/055241

§ 371 (c)(1),
(2), (4) Date: Aug. 14, 2013

(87) PCT Pub. No.: WO2012/118146

PCT Pub. Date: Sep. 7, 2012

(65) Prior Publication Data

US 2013/0330984 A1 Dec. 12, 2013

(30) Foreign Application Priority Data

Mar. 1, 2011 (JP) ..... 2011-044365

(51) Int. Cl.
*H01R 13/639* (2006.01)
*H01R 13/629* (2006.01)

(52) U.S. Cl.
CPC .... *H01R 13/62905* (2013.01); *H01R 13/62911* (2013.01); *H01R 13/6392* (2013.01)

(58) Field of Classification Search
CPC ..... H01R 13/639; H01R 13/62; H01R 13/641
USPC ..... 439/347
See application file for complete search history.

(56) References Cited

U.S. PATENT DOCUMENTS

| | | | | |
|---|---|---|---|---|
| 5,888,080 | A | 3/1999 | Maejima | |
| 6,220,886 | B1 * | 4/2001 | Kurimoto | 439/352 |
| 6,244,880 | B1 | 6/2001 | Fukase et al. | |
| 8,235,742 | B2 * | 8/2012 | Komiyama et al. | 439/347 |
| 2003/0008546 | A1 | 1/2003 | Nagamine et al. | |

FOREIGN PATENT DOCUMENTS

| | | | |
|---|---|---|---|
| CN | 1396680 | A | 2/2003 |
| JP | 4-184877 | A | 7/1992 |
| JP | 9-139252 | A | 5/1997 |

(Continued)

OTHER PUBLICATIONS

English translation of International Search Report for PCT Patent App. No. PCT/JP2012/055241 (May 29, 2012).

(Continued)

*Primary Examiner* — Gary Paumen
(74) *Attorney, Agent, or Firm* — Kenealy Vaidya LLP

(57) ABSTRACT

A connector of the present invention includes a first connector housing (11) and a second connector housing (101) which are fitted to each other, a fitting operation member (20) which makes the first connector housing 11 and the second connector housing, which are initially fitted, to be completely fitted, a grommet (40) which urges the fitting operation member to move from a standby position to an operational position, and temporary locking arms (16) which, while the fitting operation member is temporarily locked at the standby position and the first connector housing and the second connector housing are initially fitted, cancel the temporary locking.

9 Claims, 4 Drawing Sheets

(56) References Cited

FOREIGN PATENT DOCUMENTS

| | | | |
|---|---|---|---|
| JP | 11-67339 | A | 3/1999 |
| JP | 2001-52810 | A | 2/2001 |
| JP | 2009-99469 | A | 5/2009 |

OTHER PUBLICATIONS

English translation of Written Opinion for PCT Patent App. No. PCT/JP2012/055241 (May 29, 2012).

Korean Office Action for the related Korean Patent Application No. 10-2013-7023051 dated Jul. 22, 2014.

International Search Report and Written Opinion of the International Search Report for PCT/JP2012/055241 dated May 29, 2012.

Japanese Office Action for the related Japanese Patent Application No. 2011-044365 dated Nov. 17, 2014.

Chinese Office Action for the related Chinese Patent Application No. 201280011358.3 dated Apr. 29, 2015.

* cited by examiner

CONNECTOR

TECHNICAL FIELD

The present invention relates to a connector in which a first connector housing and a second connector housing are fitted.

BACKGROUND ART

Traditionally, as a connector such as a multi-electrode connector for which a high fitting force is required, a lever type connector including a lever (equivalent to a fitting operation member) for facilitating the fitting operation is used (refer to a patent document 1). In the lever type connector, the lever is rotatably attached to one of a pair of connector housings which are fitted to each other, and by rotating the lever, the two connector housings are engaged or disengaged by the operation of a cam mechanism provided between the lever and the other connector housing.

RELATED ART DOCUMENTS

Patent Documents

[Patent document 1] JP-A-2009-99469

SUMMARY OF INVENTION

Technical Problems

In the traditional connector, because the force with which the lever is operated totally depends on hands, there is a problem that the efficiency of the operation is low.

Thus, the purpose of the present invention is to solve the above problem and provide a connector so that the force with which the connector is fitted by hands can be eliminated or reduced.

Solution to Problems

The above object of the present invention is achieved by the following configurations.

(1) A connector comprising:

a first connector housing and a second connector housing, configured to connect terminals which are held in the first connector housing and the second connector housing respectively, by being completely fitted to each other;

a fitting operation member, provided to be displaceable in a direction intersecting with a direction in which the first connector housing and the second connector housing are fitted, and configured to be displaced from a standby position to an operational position so as to make the first connector housing and the second connector housing, which are initially fitted, completely fitted by means of a cam mechanism;

an elastic member urging the fitting operation member t from the standby position to the operational position; and a temporary locking mechanism, configured to temporarily lock the fitting operation member receiving an urging force of the elastic member at the standby position before the first connector housing and the second connector housing are initially fitted, wherein a temporary locking is released when the first connector housing and the second connector housing are initially fitted.

(2) The connector according to the above (1), wherein the fitting operation member is mounted to the first connector housing to be slidable in a direction perpendicular to the direction the first connector housing and the second connector housing are fitted, the fitting operation member is formed with cam a groove configured to engage with a projection provided on the second connector housing when the first connector housing and the second connector housing are initially fitted, wherein, in the state, the fitting operation member is slid from the standby position where the fitting operation member laterally projects from the first connector housing to the operational position where the fitting operation member is accommodated in the side of the first connector housing, so that the second connector housing to be drawn into the first connector housing to be completely fitted with the first connector housing, the cam mechanism is constructed of the projection and the cam groove, a grommet is mounted to cover the first connector housing, the grommet is provided as the elastic member which is elastically deformed and kept in an expanded state while the fitting operation member is at the standby position, and which urges the fitting operation member from the standby position to the operational position with a force produced when the grommet tends to be contracted, and the first connector housing is provided a temporary locking arm as the temporary locking mechanism which temporarily locks the fitting operation member receiving the force when the grommet tends to be contracted at the standby position before the first connector housing and the second connector housing are initially fitted, and which is pressed by the projection of the second connector housing to be deformed so that the temporary locking is released when the first connector housing and the second connector housing are initially fitted.

According to the above configuration (1), when the first connector housing and the second connector housing are initially fitted, the elastic member automatically applies the urging force as an operation force to the fitting operation member to displace the fitting operation member from the standby position to the operational position, and thereby the first connector housing and the second connector housing are completely fitted. As a result, the force applied by hands to fit the first connector housing and the second connector housing can be reduced or even eliminated, and the efficiency of the fitting operation can be improved.

According to the above configuration (2), the first connector housing has the cam groove, the fitting operation member is mounted to the first connector housing to be slidable in the direction perpendicular to the direction the connectors are fitted, and the second connector housing is provided with the projections to engage with the cam groove. Thus, the projection is so constructed that when the projection make the fitting operation member not be temporarily locked at the standby position any more by the temporary locking arm, the fitting operation member is slid to the operational position by the elasticity of the grommet mounted to the first connector housing. Therefore, it is not necessary to provide another elastic member other than the grommet, and the configuration can be simplified.

Advantageous Effects of Invention

According to the present invention, because the fitting operation member can be displaced from the standby position to the operational position using the elasticity of the elastic member, the force applied by hands to fit the first connector housing and the second connector housing can be reduced or even eliminated, and the efficiency of the fitting operation can be improved.

DESCRIPTION OF EMBODIMENTS

Below, the embodiments of the invention are explained with reference to the figures.

Figure 1A:
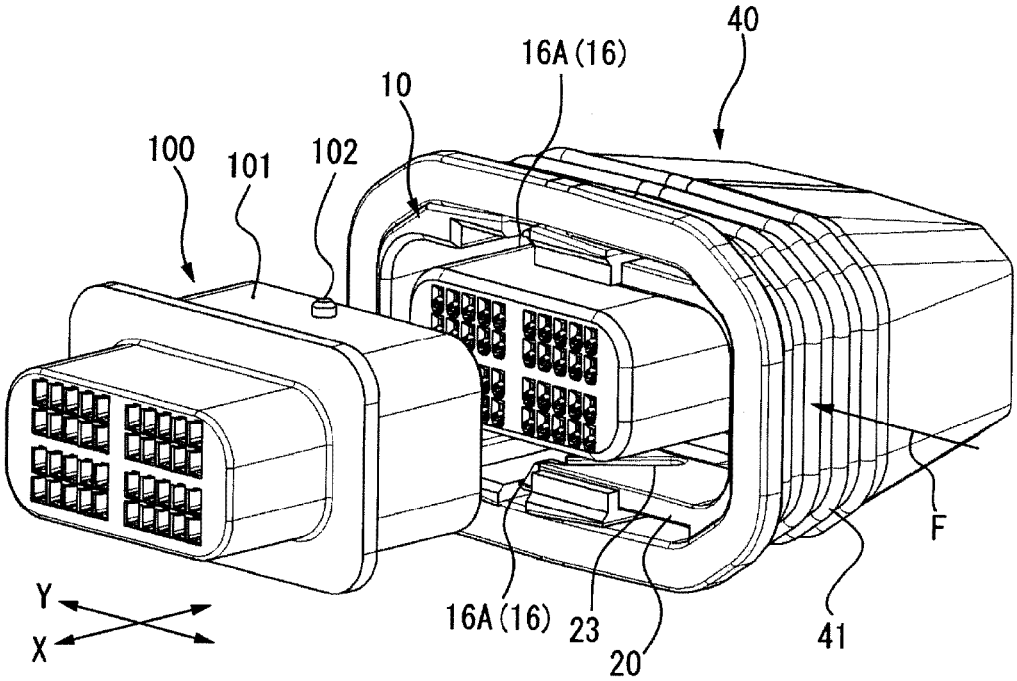
FIG. 1A is a perspective view which shows a state before a connector of an embodiment of the present invention is fitted.
Figure 1B:
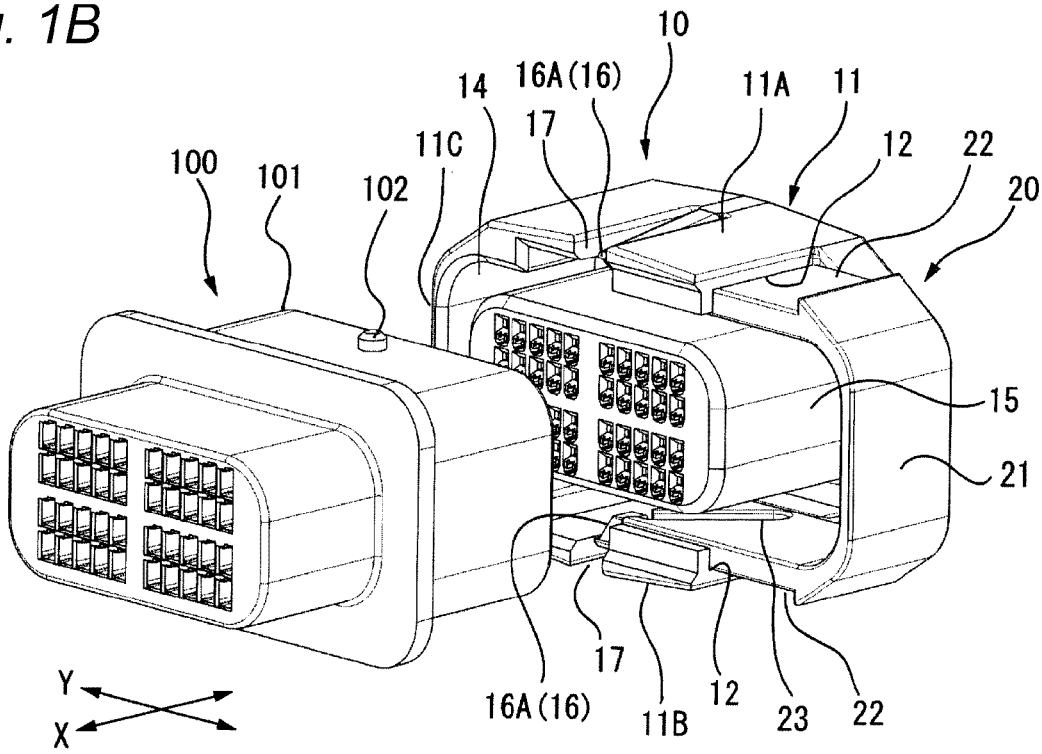
FIG. 1B is a perspective view which shows the connector from which a grommet is removed.
Figure 2A:
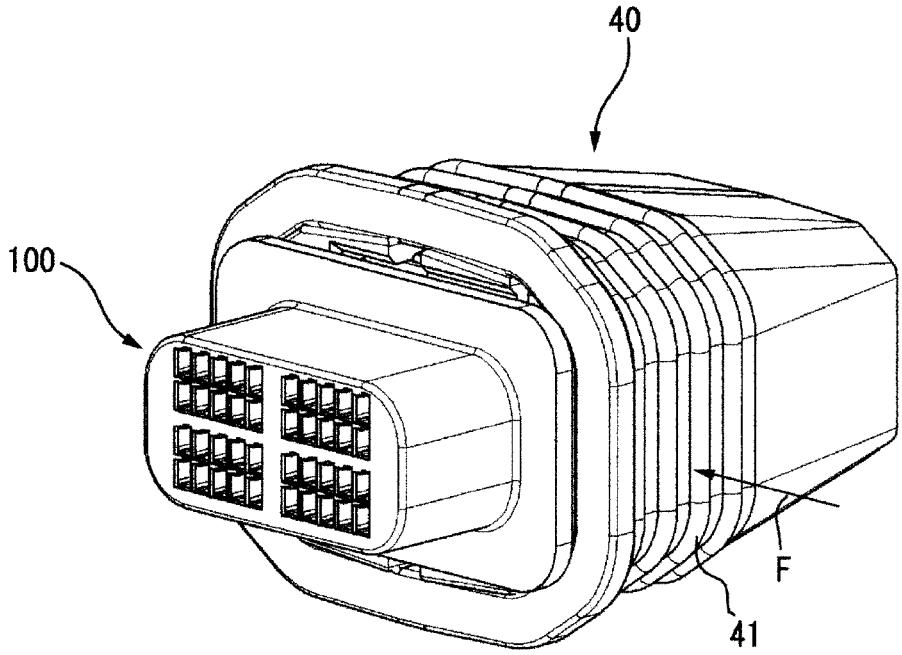
FIG. 2A is a perspective view which shows a state after the connector is fitted.
Figure 2B:
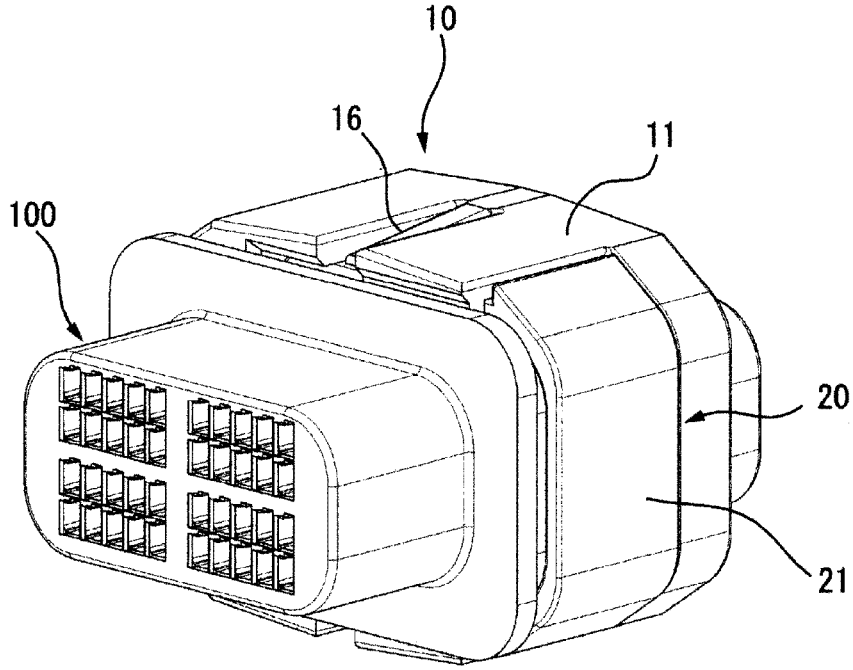
FIG. 2B is a perspective view which shows the connector from which the grommet is removed.
Figure 3:
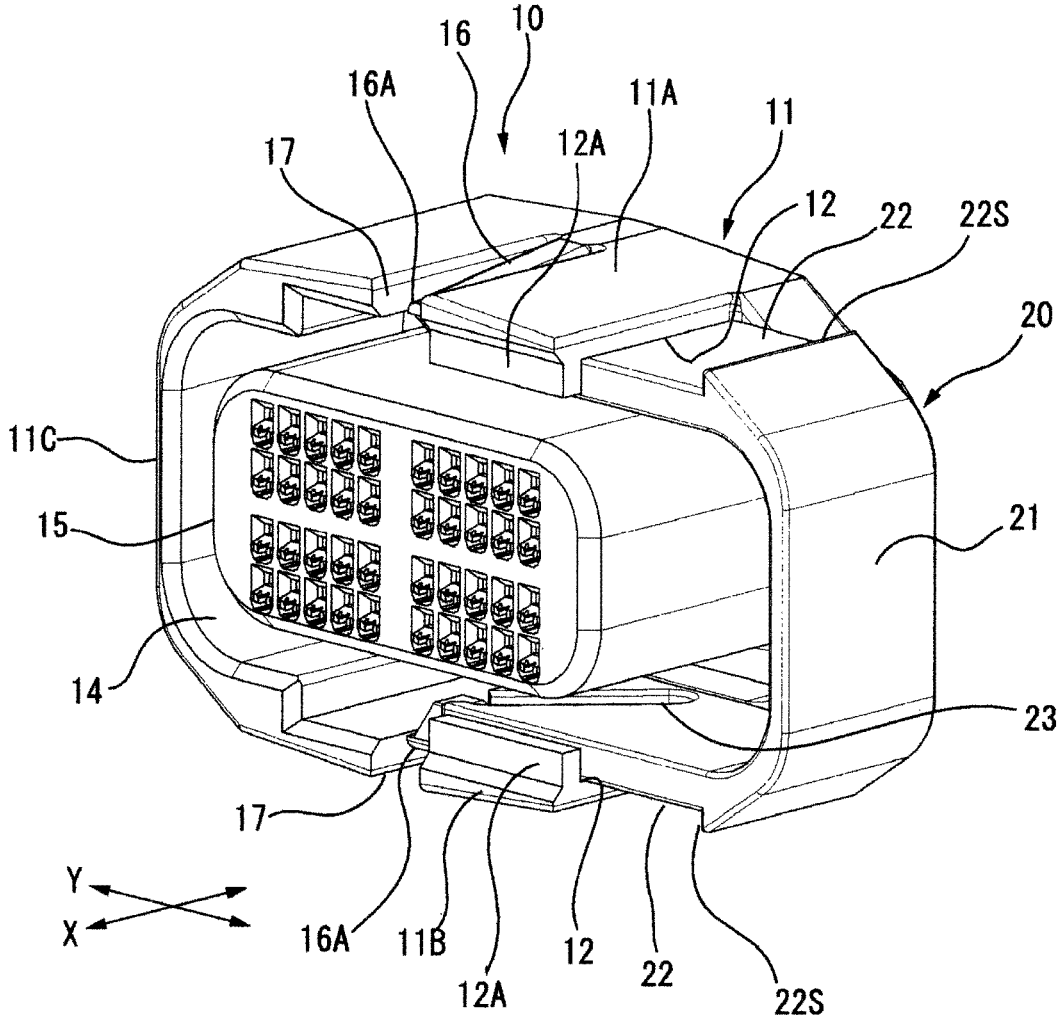
FIG. 3 is a perspective view which shows the configuration of a first connector housing (female connector housing) side of the connector.

FIG. 1A is a perspective view which shows a state before a connector of one embodiment is fitted. FIG. 1B is a perspective view which shows the connector from which a grommet is removed. FIG. 2A is a perspective view which shows a state after the connector is fitted. FIG. 2B is a perspective view which shows the connector from which the grommet is removed. FIG. 3 is a perspective view which shows the configuration of a first connector housing (female connector housing) side of the connector.

The connector includes a first connector (female connector) 10 and a second connector (male connector) 100 which are fitted to each other, and a grommet (equivalent to an elastic member) 40 of elastic material (for example, rubber) which is mounted to cover the periphery of the first connector 10.

The first connector 10 and the second connector 100 mainly have a first connector housing (female connector housing) 11 and a second connector housing (male connector housing) 101. When the first connector 10 and the second connector 100 are completely fitted to each other, terminals (not shown in the figure) that are respectively held in the first connector housing 11 and the second connector housing 101 are connected. The first connector 10 and the second connector 100 are constructed by accommodating and fixing the terminals in the connector housings 11, 101, and a fitting operation member 20 is mounted to the first connector housing 11 so as to be displaced.

When the direction in which the first connector 10 and the second connector 100 are fitted is assumed as a forward/backward direction (referred to as X direction hereinafter), the fitting operation member 20 is provided to be slidable in the leftward/rightward direction (referred to as Y direction hereinafter) perpendicular to the X direction. The fitting operation member 20 is slid from a standby position where the fitting operation member 20 laterally projects from the first connector housing 11, as shown in FIG. 1B, to an operational position where the fitting operation member 20 is accommodated in the side of the first connector housing 11, as shown in FIG. 2B. When the fitting operation member 20 is slid in this way, the first connector housing 11 and the second connector housing 101, which was initially fitted, are made to be completely fitted.

For this purpose, the fitting operation member 20 is formed with cam grooves 23. The cam grooves 23 engage with projections 102 that the second connector housing 101 is provided with when the first connector housing 11 and the second connector housing 101 are initially fitted. While the cam grooves 23 engage with the projections 102, the cam grooves 23 is slid from the standby position where the fitting operation member 20 laterally projects from the first connector housing 11 to the operational position where the fitting operation member 20 is accommodated in the side of the first connector housing 11 so that the second connector housing 101 is drawn into the first connector housing 11 and is completely fitted with the first connector housing 11. The cam grooves 23 and the projections 102A form a cam mechanism to convert sliding movement of the fitting operation member 20 into fitting movement of the first connector housing 11 and the second connector housing 101.

The configurations of the first connector 10 and the second connector 100 are described in more detail as follows. As shown in FIG. 3, the first connector housing 11 is provided with a central hub part 15 which projects forwards when seen from the front, and a peripheral side wall including a top wall 11A, a bottom wall 11B and a left side wall 11C. There is an annular groove 14 between the periphery of the central hub part 15 and the peripheral side wall. The right side wall of the first connector housing 11 is cut out, and the fitting operation member 20 is mounted at the position of the right side wall. The terminals are accommodated and fixed into the central hub part 15.

Figure 4:
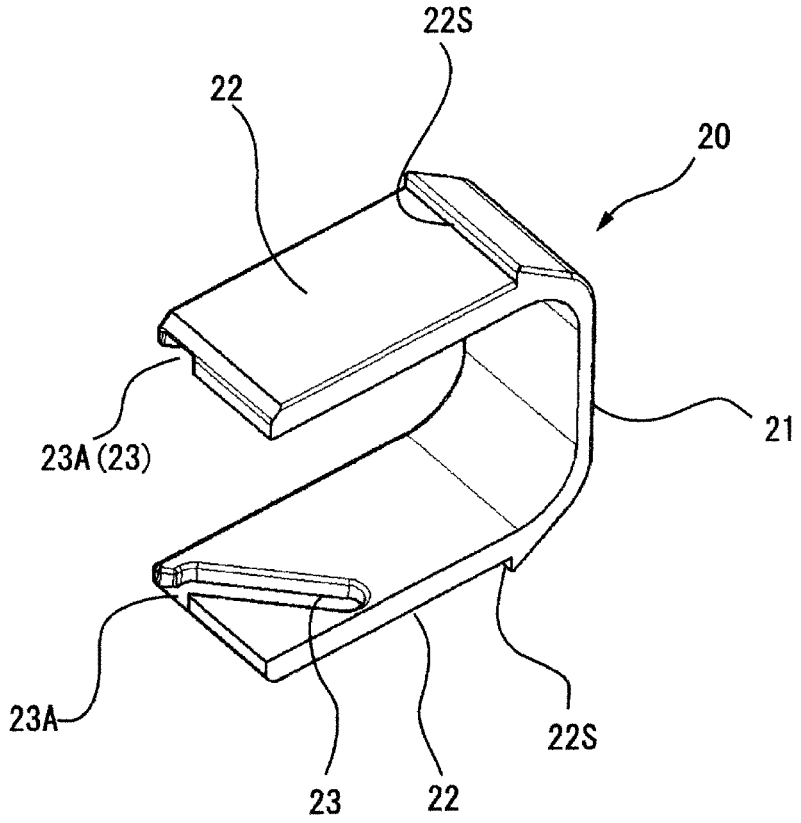
FIG. 4 is a perspective view which shows the configuration of a fitting operation member which is mounted to the first connector housing.

As shown in FIG. 4, the fitting operation member 20 is formed into a U shape by connecting the based ends of a pair of slide walls 22, 22, which are parallel to each other, with a connecting wall 21. The fitting operation member 20 is mounted to be slidable in the Y direction when the slide walls 22, 22 are embedded in slide guides 12 formed on the inner surfaces of the top wall 11A and the bottom wall 11B of the first connector housing 11. The inner surfaces of the upper and lower slide walls 22, 22 of the fitting operation member 20 are exposed to the annular groove 14 into which the front part of the peripheral wall of the second connector housing 101 enters.

The inner surfaces of the upper and lower slide walls 22 which are exposed to the annular groove 14 are formed with the cam grooves 23. Distal ends 23A of the cam grooves 23 are at the distal ends of the slide walls 22 where the cam grooves 23 open so that the projections 102 of the second connector housing 101 can be received. On the other hand, the projections 102 of the second connector housing 101 project from the top and bottom wall surfaces of the second connector housing 101 in accordance with the cam grooves 23, and are arranged at approximately central positions in the leftward/rightward direction of the second connector housing 101. The slide guides 12 are provided with regulating walls 12A to regulate the fitting operation member 20 from moving out to the front side.

The connecting wall 21 of the fitting operation member 20 has a shape corresponding to the right side wall of the first connector housing 11. The connecting wall 21 is so constructed that when the fitting operation member 20 is pushed into the operational position as shown in FIG. 2B, the connecting wall 21 is just fitted to the position of the right side wall, which is cut, of the first connector housing 11. Furthermore, the outer surfaces of the base parts of the slide walls 22 are provided with stepped portions 22S as slide stoppers.

On the other hand, as shown in FIGS. 1 and 2, the grommet 40 as the elastic member has a pipe-formed wall 41 which is fitted to the outer side of the fitting operation member 20 and the periphery of the first connector housing 11. When the fitting operation member 20 is at the standby position, the pipe-formed wall 41 of the grommet 40 is elastically deformed to be kept in an expanded condition and tends to be contracted inward. The grommet 40 is so constructed that when the force with which the grommet 40 is contracted is applied on the fitting operation member 20, the grommet 40 makes the fitting operation member 20 tend to move from the standby position toward the operational position.

The top wall 11A and the bottom wall 11B of the first connector housing 11 are provided with temporary locking arms 16 as temporary locking mechanisms which temporarily lock the fitting operation member 20 which is receiving the force which makes the pipe-formed wall 41 of the grommet 40 tend to be contracted. The temporary locking arms 16 temporarily lock the fitting operation member 20, which is receiving the force, at the standby position before the first connector housing 11 and the second connector housing 101 are initially fitted. When the first connector housing 11 and the second connector housing 101 are initially fitted, the temporary locking arms 16 are deformed by being pushed to the projections 102 of the second connector housing 101 so that the temporary locking is released.

That is, the temporary locking arms 16 are constructed as cantilevers whose back ends are fixed and whose front ends become free ends. The temporary locking arms 16 are placed in insert slots 17 formed in the top wall 11A and the bottom wall 11B of the first connector housing 11. Because locking salients 16A at the front ends of the temporary locking arms 16 project into the annular groove 14 in a free state, the front ends of the slide walls 22 of the fitting operation member 20 are locked by the side of the locking salients 16A. When the projections 102 of the second connector housing 101 enter into the insert slots 17 while the first connector housing 11 and the second connector housing 101 are initially fitted, the locking salients 16A of the temporary locking arms 16 are pushed outward so that the fitting operation member 20 is unlocked.

Next, the operation will be described.

First, as shown in FIG. 3, the fitting operation member 20 is mounted to the first connector housing 11, and the fitting operation member 20 is maintained at the standby position by the temporary locking arms 16. In this state, as shown in FIG. 1, the grommet 40 is mounted to the periphery of the first connector 10 while the pipe-formed wall 41 of the grommet 40 is expanded rightward and leftward. Thereby, an urging force can be applied on the fitting operation member 20 because of the elastic contraction force F of the grommet 40.

In this state, when the second connector 100 is initially fitted in the first connector 10, the projections 102 of the second connector housing 101 enter into the insert slots 17 of the first connector housing 11 and the temporary locking arms 16 are pushed outward. With these movements, the temporary locking arms 16 do not temporarily lock the fitting operation member 20 anymore, and the fitting operation member 20 is pushed inward by the elasticity of the grommet 40. When the fitting operation member 20 is pushed inward, the projections 102 that entered the insert slots 17 get into the cam grooves 23 from the front ends of the cam grooves 23. In this state, when the fitting operation member 20 is further pushed by the elasticity of the grommet 40, the cam grooves 23 draw the second connector housing 101 into the first connector housing 11 by means of the projections 102. By the collaboration of the cam grooves 23 and the projections 102, the second connector housing 101 is completely fitted in the first connector housing 11.

As described above, in one embodiment of the present invention, when the first connector housing 11 and the second connector housing 101 are initially fitted, the grommet 40 automatically applies the elastic urging force as an operation force to the fitting operation member 20 to displace the fitting operation member 20 from the standby position to the operational position, and thereby the first connector housing 11 and the second connector housing 101 are completely fitted. Thereby, the force applied by hands to fit the first connector housing 11 and the second connector housing 101 can be reduced or even eliminated, and the efficiency of the fitting operation can be improved.

Particularly, in one embodiment of the present invention, the first connector housing 11 has the cam grooves 23, the fitting operation member 20 is mounted to the first connector housing 11 to be slidable in the direction (Y direction) perpendicular to the direction the first and second connectors are fitted, and the second connector housing 101 is provided with the projections 102 to engage with the cam grooves 23. According to this arrangement, when the projections 102 make the fitting operation member 20 not be temporarily locked at the standby position any more by the temporary locking arms 16, the fitting operation member 20 is slid to the operational position by the elasticity of the grommet 40 mounted to the first connector housing 11. Thereby, it is not necessary to provide another elastic member other than the grommet 40, and the configuration can be simplified.

The present invention is not limited to the above-described embodiments, and suitable modifications, improvements and the like can be made. Moreover, the materials, shapes, dimensions, numbers, installation places, and the like of the components in the above embodiment are arbitrarily set as far as the invention can be attained, and not particularly restricted.

Although the invention is described in detail with reference to specific embodiments, it is apparent that various modifications and amendments may be made by those skilled in the art without departing from the spirit and scope of the invention.

This application is based on the Japanese patent application (patent application 2011-044365) filed on Mar. 1, 2011, whose content is incorporated herein by reference.

INDUSTRIAL APPLICABILITY

According to the connector of the present invention, by making the fitting operation member displace from the standby position to the operational position using the elasticity of the elastic member, the force applied by hands to fit the first connector housing and the second connector housing can be reduced or even eliminated. Therefore, according to the connector of the present invention, the efficiency of the fitting operation can be improved.

REFERENCE SIGNS LIST

11 first connector housing
20 fitting operation member
23 cam groove (cam mechanism)
101 second connector housing
102 projection (cam mechanism)
40 grommet (elastic member)
16 temporary locking arm (temporary locking mechanism)

The invention claimed is:

1. A connector comprising:

a first connector housing and a second connector housing, configured to connect terminals which are held in the first connector housing and the second connector housing respectively, by being completely fitted to each other;

a fitting operation member, provided to be displaceable in a direction intersecting with a direction in which the first connector housing and the second connector housing are fitted, and configured to be displaced from a standby position to an operational position so as to make the first connector housing and the second connector housing, which are initially fitted, completely fitted by means of a cam mechanism;

an elastic member urging the fitting operation member from the standby position to the operational position; and a temporary locking mechanism, configured to temporarily lock the fitting operation member receiving an urging force of the elastic member at the standby position before the first connector housing and the second connector housing are initially fitted, wherein a temporary locking is released when the first connector housing and the second connector housing are initially fitted, wherein the elastic member is mounted to cover the first connector housing, the elastic member is elastically deformed and kept in an expanded state while the fitting operation member is at the standby position, and which urges the fitting operation member from the standby position to the operational position with a force produced when the elastic member tends to be contracted.

2. The connector according to claim 1, wherein the fitting operation member is mounted to the first connector housing to be slidable in a direction perpendicular to the direction the first connector housing and the second connector housing are fitted, the fitting operation member is formed with cam a groove configured to engage with a projection provided on the second connector housing when the first connector housing and the second connector housing are initially fitted, wherein, in the state, the fitting operation member is slid from the standby position where the fitting operation member laterally projects from the first connector housing to the operational position where the fitting operation member is accommodated in the side of the first connector housing, so that the second connector housing to be drawn into the first connector housing to be completely fitted with the first connector housing, the cam mechanism is constructed of the projection and the cam groove, wherein the elastic member is a grommet, and the first connector housing is provided a temporary locking arm as the temporary locking mechanism which temporarily locks the fitting operation member receiving the force when the grommet tends to be contracted at the standby position before the first connector housing and the second connector housing are initially fitted, and which is pressed by the projection of the second connector housing to be deformed so that the temporary locking is released when the first connector housing and the second connector housing are initially fitted.

3. The connector according to claim 1, wherein the temporary locking mechanism includes a pair of locking arms, one of the locking arms being disposed at a top wall of the first connector housing, and the other of the locking arms being disposed at a bottom wall of the first connector housing.

4. The connector according to claim 3, wherein the second housing defines a pair of projections that are configured and disposed to cooperate with the pair of locking arms when the first connector housing and the second connector housing are initially fitted, one of the pair of projections being disposed at a top wall of the second connector housing, and the other of the pair of projections being disposed at a bottom wall of the second connector housing.

5. The connector according to claim 1, wherein the fitting operation member is configured so that an exterior surface thereof is flush with an exterior surface of the first connector housing when the fitting operation member is in the operational position.

6. The connector according to claim 5, wherein the fitting operation member is U-shaped in cross-section.

7. The connector according to claim 1, wherein the elastic member consists of a grommet that covers the entire exterior surface of the fitting operation member when the fitting operation member is in the operational position.

8. The connector according to claim 7, wherein the grommet includes an exterior wall defining ribs.

9. The connector according to claim 8, wherein each of the ribs extends circumferentially around the grommet.

* * * * *